US010791819B2

(12) United States Patent
Caccamise

(10) Patent No.: US 10,791,819 B2
(45) Date of Patent: Oct. 6, 2020

(54) LOOSE STRAND RETAINER

(71) Applicant: Jeana Caccamise, Rochester, NY (US)

(72) Inventor: Jeana Caccamise, Rochester, NY (US)

( * ) Notice: Subject to any disclaimer, the term of this patent is extended or adjusted under 35 U.S.C. 154(b) by 0 days.

(21) Appl. No.: 16/286,499

(22) Filed: Feb. 26, 2019

(65) Prior Publication Data

US 2020/0268129 A1 Aug. 27, 2020

(51) Int. Cl.
*A45D 44/16* (2006.01)
*A46B 15/00* (2006.01)

(52) U.S. Cl.
CPC ..... *A45D 44/16* (2013.01); *A46B 15/0097* (2013.01); *A46B 2200/405* (2013.01)

(58) Field of Classification Search
CPC ..... A45D 44/16; A46B 15/0097; A46B 2200/405
See application file for complete search history.

(56) References Cited

U.S. PATENT DOCUMENTS 5,228,165 A * 7/1993 Westberry ..... A47K 7/024 15/160
D351,505 S * 10/1994 Mastellone ..... D4/116
6,226,811 B1 * 5/2001 Fagan ..... A47K 7/024 15/207.2
D457,985 S * 5/2002 McNaughton ..... D28/63
6,647,564 B1 * 11/2003 Smith ..... A47K 7/024 15/176.5
7,407,142 B1 8/2008 Lopez
D584,863 S * 1/2009 Garry ..... D30/158
7,500,282 B1 * 3/2009 Park ..... A47K 7/02 15/160
9,131,810 B2 9/2015 Reile
9,549,611 B1 1/2017 Bocanegra
9,889,065 B2 * 2/2018 Sedic ..... A47K 7/043
D817,571 S * 5/2018 Campbell ..... D32/35
D870,387 S * 12/2019 Sherrill ..... D28/57
2016/0309886 A1 * 10/2016 Oldham ..... A46B 15/0097
2018/0064233 A1 * 3/2018 Riley ..... A46B 3/005
2019/0313780 A1 * 10/2019 Watne ..... A47K 3/281

FOREIGN PATENT DOCUMENTS

JP 2005224390 A * 8/2005

* cited by examiner

*Primary Examiner* — Marc Carlson
(74) *Attorney, Agent, or Firm* — Tracy Jong Law Firm; Tracy P. Jong; Cheng Ning Jong

(57) ABSTRACT

A loose strand retainer including:
(a) only one base, the only one base including a top surface configured for receiving and retaining loose strands and a bottom surface; and
(b) an attachment means disposed on the bottom surface, the attachment means configured for attaching the loose strand retainer to a support surface.

10 Claims, 8 Drawing Sheets

FIG. 11
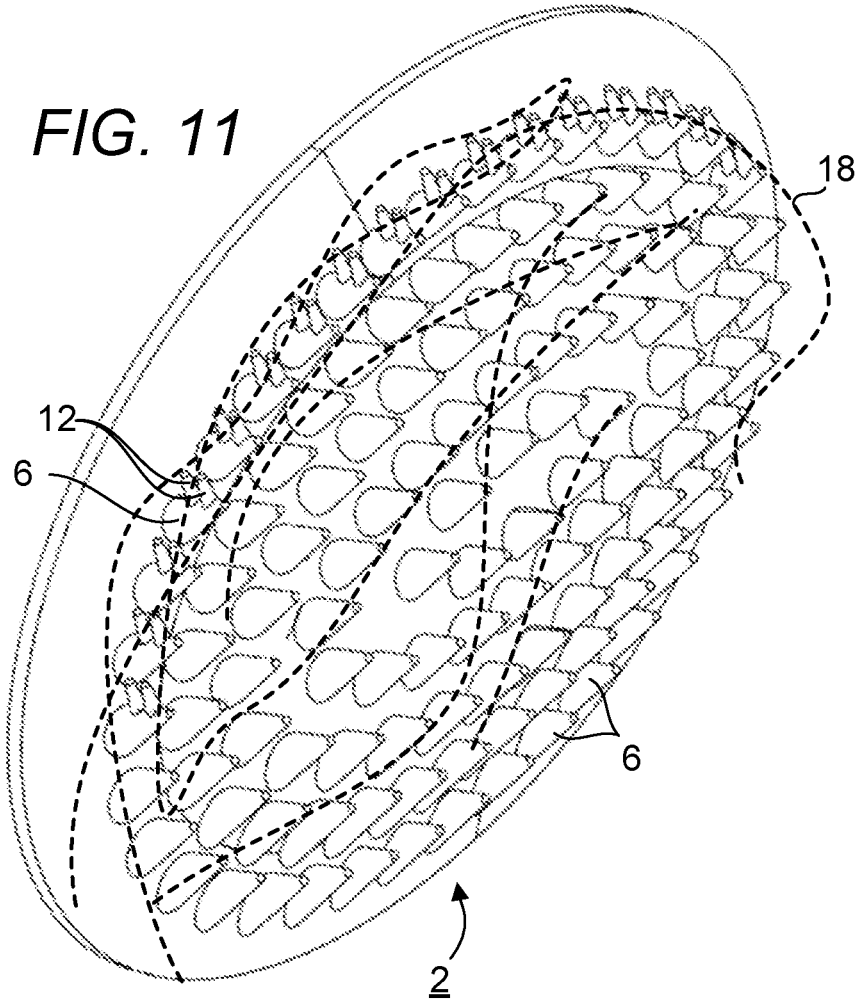
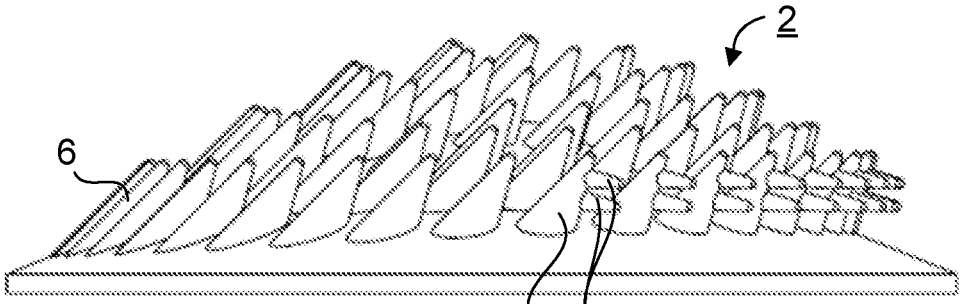
FIG. 12

LOOSE STRAND RETAINER

BACKGROUND OF THE INVENTION

1. The Field of the Invention

The present invention relates to a device for securing and collecting loose hair. More specifically, the present invention is directed to a device for securing and collecting loose hair from a wet environment.

2. Background Art

While showering, washing, conditioning, styling, blow-drying, curling, straightening and braiding, a user may end up with strands of loose hair or synthetic hair stuck in his or her hand when his or her hand is run over his or her long hair. Further it is possible for the user to attempt to gather loose hair that have fallen to the shower floor and discard of it in a bin outside of the shower. It is in the user's interest to get the strands removed so that the user's hand is free from the entangled hair strands. However, those who have tried to remove loose long hair from a wet hand would find it difficult if not impossible to remove the loose hair from their hands until the hand is dried with a towel. Accessing a towel while taking a shower is not an option most would partake. If unattended to, fallen long hair in a drain of the shower can sufficiently collect in a drain to clog it up over time. In some cases, a user may alternatively attempt to "stick" the fallen hair to the wall of a shower or bath, by virtue of the fallen hair being already wetted from the shower or bath. However, the wetted fallen hair strands can quickly dry up to cause them to be released from the wall and be washed down the drain. There exists a need for a device for temporarily securing and collecting or retaining fallen hair in a shower or bath room in order to keep the fallen hair from reaching the drain of the shower or bath which can clog the drain over time. The device is preferably easy to use and the hair temporarily collected or lodged in the device is preferably separable easily from the device for disposal. Several devices have been attempted in the past. However, none of the prior art devices disclosed elsewhere herein were suitable to be used in a wet environment as they will require excessive maintenance while not allowing "no look" uses of the devices, i.e., using the devices without having to pay attention to the devices.

U.S. Pat. No. 9,131,810 to Reile (Hereinafter Reile) discloses a hair collection system including a backboard for providing a location for detached hair collection, a basin for capturing detached hair, and an attachment means to couple the system to a wall. The system provides a method and apparatus for collecting detached hair before it becomes entrapped in the drain. Although a collection box to contain fallen hair is placed therein and an insert that can be used to lift the collected fallen hair to be disposed of is provided in Reile, no part of Reile is provided to facilitate separation of the fallen hair from one's hand.

U.S. Pat. No. 9,549,611 to Bocanegra (Hereinafter Bocanegra) discloses a shower caddy including horizontal shelves and a vertically sloped panel having a smooth surface. A bottom edge of the panel is positioned above and in registration with a hair screen carried within a lowermost shelf. Hair from one's head and body caught on one's hands and fingers during washing are transferred to the panel by touching the panel or land directly on the panel. Water overspray during showering or direct splashing causes the hair to slide down the panel and become trapped in the screen. Bocanegra's caddy is a complex structure with a collection of parts, among many other parts, a rectangular planar panel and a hair collection screen that tends to collect overspray in use. Further, Bocanegra's caddy allows loose hair collected in its hair collection screen to fall out as the loose hair is sufficiently secured, especially after the loose hair and hair collection screen have dried.

U.S. Pat. No. 7,407,142 to Lopez (Hereinafter Lopez) discloses a hair collection device for collecting hair from the hand of a user to remove hair from the head left on the hand of the user during a shower. The hair collection device includes a collection member being designed for being selectively coupled to a wall of the shower. The collection member is designed for receiving the hair from the hand of the user to allow the user to collect the hair at a later time to be thrown out when the hand of the user is wiped across the collection member. Lopez discloses a device having protrusions covered with hook and loop materials which helps segregate and transfer hair strands from the user's hand to the device. Lopez's device requires an excessive amount of maintenance as overspray received in a shower can clog up hook and loop materials disposed on the large protrusion. Lopez's device is not intuitive from the perspective of a user and the result of using Lopez's device may cause any user-accessible parts of Lopez's device to be tangled with loose hair, making the device difficult to clean.

SUMMARY OF THE INVENTION

In accordance with the present invention, there is provided a loose strand retainer including:

(a) only one base, the only one base including a top surface configured for receiving and retaining loose hair and a bottom surface; and (b) an attachment means disposed on the bottom surface, the attachment means configured for attaching the loose strand retainer to a support surface.

In accordance with the present invention, there is further provided a loose strand retainer including:

(a) a base including a top surface and a bottom surface;

(b) an attachment means disposed on the bottom surface, the attachment means configured for attaching the loose strand retainer to a support surface; and (c) a plurality of protrusions disposed on the top surface, wherein the plurality of protrusions are configured for receiving and retaining loose hair.

In one embodiment, the base further includes a central plane and the plurality of protrusions are biased with respect to the central plane. In one embodiment, the attachment means includes a lip disposed about a periphery of the base, the lip configured to seal the base on the bottom surface from an ambient environment when the loose strand retainer has been attached to the support surface to avoid intrusion of any fluids at the bottom surface. In one embodiment, the attachment means is a suction cup.

In one embodiment, the loose strand retainer is constructed as a single unit. In one embodiment, the loose strand retainer is constructed from a resilient material. The resilient material may be silicone, thermoplastic elastomer (TPE) and thermoplastic polyurethane (TPU). In one embodiment, the plurality of protrusions are disposed on the top surface at a density of about 15 to about 20 per square inch.

In one embodiment, at least one of the plurality of protrusions extends from the top surface to a pointed end. In one embodiment, the loose strand retainer further includes a pull tab attached to the base. In one embodiment, the height of at least one of the plurality of protrusions ranges from about 0.5 inch to about 1 inch.

An object of the present invention is to provide a loose strand retainer that can be used without requiring meticulous attention on the part of a user of the loose strand retainer.

An object of the present invention is to provide a loose strand retainer that is minimalist and simplistic in construction so as to avoid soiling of the loose strand retainer in use such that the loose strand retainer requires little or no cleaning or maintenance.

Another object of the present invention is to provide a temporary loose hair collection device that is capable of sufficiently securing the loose hair before the device is being emptied.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 11 is a top front perspective view of another embodiment of a loose strand retainer.

FIG. 12 is a right side view of the embodiment of a loose strand retainer shown in FIG. 11.

PARTS LIST

2—loose strand retainer
4—base
6—protrusion or bristle
8—attachment means
10—edge of base
12—extension
14—central plane
16—support surface
18—hair
20—length of base
22—width of base
24—hand
26—bias angle
28—height of protrusion
30—lip
32—structure providing rigidity to base
34—pull tab
36—height of loose strand retainer

PARTICULAR ADVANTAGES OF THE INVENTION

The present loose strand retainer is compact, simplistic in its construction and presents a minimal surface areas to get soiled as there exists only one attachment means and the device is configured to be attached to a surface, e.g., a wall, a countertop or a table top, etc., with the attachment means concealed such that it does not get soiled or wetted. All exposed surfaces are surfaces used for user interaction, thereby eliminating any need for the attachment means to be cleaned. Front surfaces that are exposed to splashes or overspray of a shower can readily dry as they do not collect and retain splashes, therefore not allowing mold to develop. Further, the present loose strand retainer may be constructed as a single piece or unit, e.g., via casting.

The present loose strand retainer is easy to use. A user, upon grasping a few strands of hair can simply wipe his or her hand across the loose strand retainer without looking or paying attention to the loose strand retainer and the manner in which the hair can be transferred onto the loose strand retainer. Contrast this to the devices of Reile, Bocanegra and Lopez disclosed elsewhere herein where a user of each of these devices must first locate the specific part/s of the devices which are designed to retain the loose hair the user is intending to transfer to the device. Then, non-intuitively, the user must manipulate and rub his or her hand against the specific part/s to transfer the loose hair from his or her hand to the device. Further, the present loose strand retainer is constructed from a resilient material which causes the protrusions to be sufficiently flexible, further enhancing the ease of transferring loose hair to the device.

In one embodiment, the attachment means of the present device is self-contained and does not require other additional parts for the attachment means to function. No modifications of a surface to which the attachment means is used to attach the device to the surface, is required.

DETAILED DESCRIPTION OF A PREFERRED EMBODIMENT

The term "about" is used herein to mean approximately, roughly, around, or in the region of. When the term "about"

is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
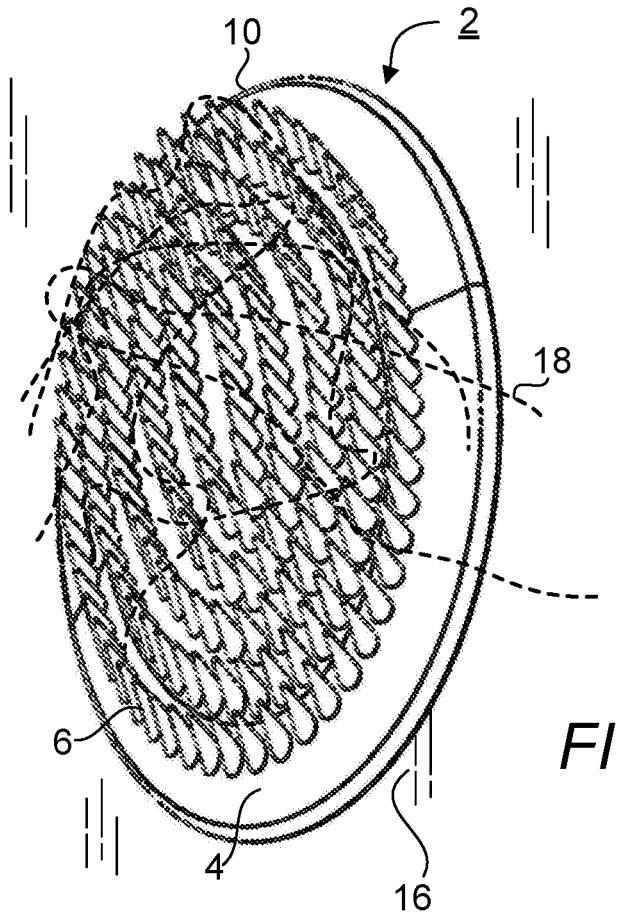
FIG. 1 is a right front side perspective view of one embodiment of a loose strand retainer where the loose strand retainer is shown attached to a support surface.

FIG. 1 is a right front side perspective view of one embodiment of a loose strand retainer 2 where the loose strand retainer 2 is shown attached to a support surface 16. The support surface 16 may be a glass surface or any surfaces sufficiently smooth to allow the retainer 2 to be attached securely to the surface by means of a suction cup. The loose strand retainer 2 is shown attached a vertical wall although it may be attached to any horizontal surfaces, e.g., a countertop or a table top, etc. The loose strand retainer 2 includes a base 4 having a top surface and a bottom surface. A plurality of protrusions 6 are disposed on the top surface, the plurality of protrusions 6 are configured for receiving and retaining loose hair 18. An attachment means which is not visible in FIG. 1 is disposed on the bottom surface, the attachment means configured for attaching the loose strand retainer 2 to a support surface 16. It shall be noted that the loose strand retainer 2 has been installed in an orientation such that the plurality of protrusions 6 are biased upwardly. In one embodiment, the plurality of protrusions 6 are disposed on the top surface at a density of about 15 to 20 per square inch surface area of the base 4. In one embodiment, a protrusion is configured to be about ⅛ inch at its base.

Figure 2:
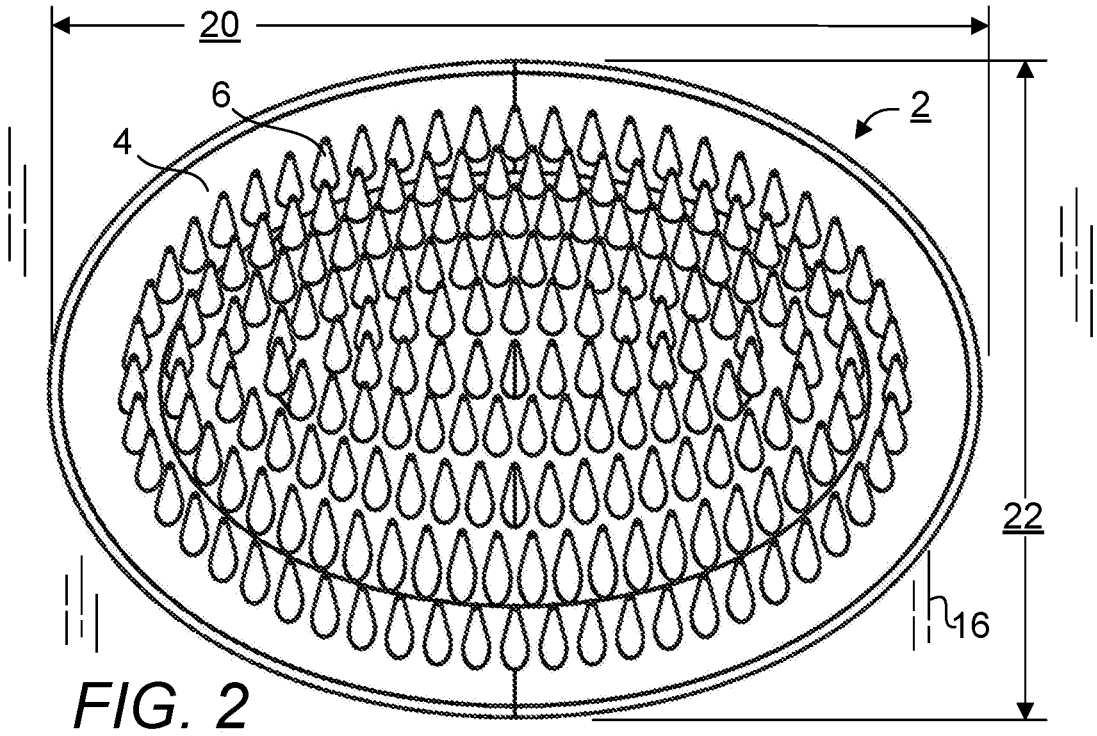
FIG. 2 is a front view of one embodiment of a loose strand retainer.
Figure 3:
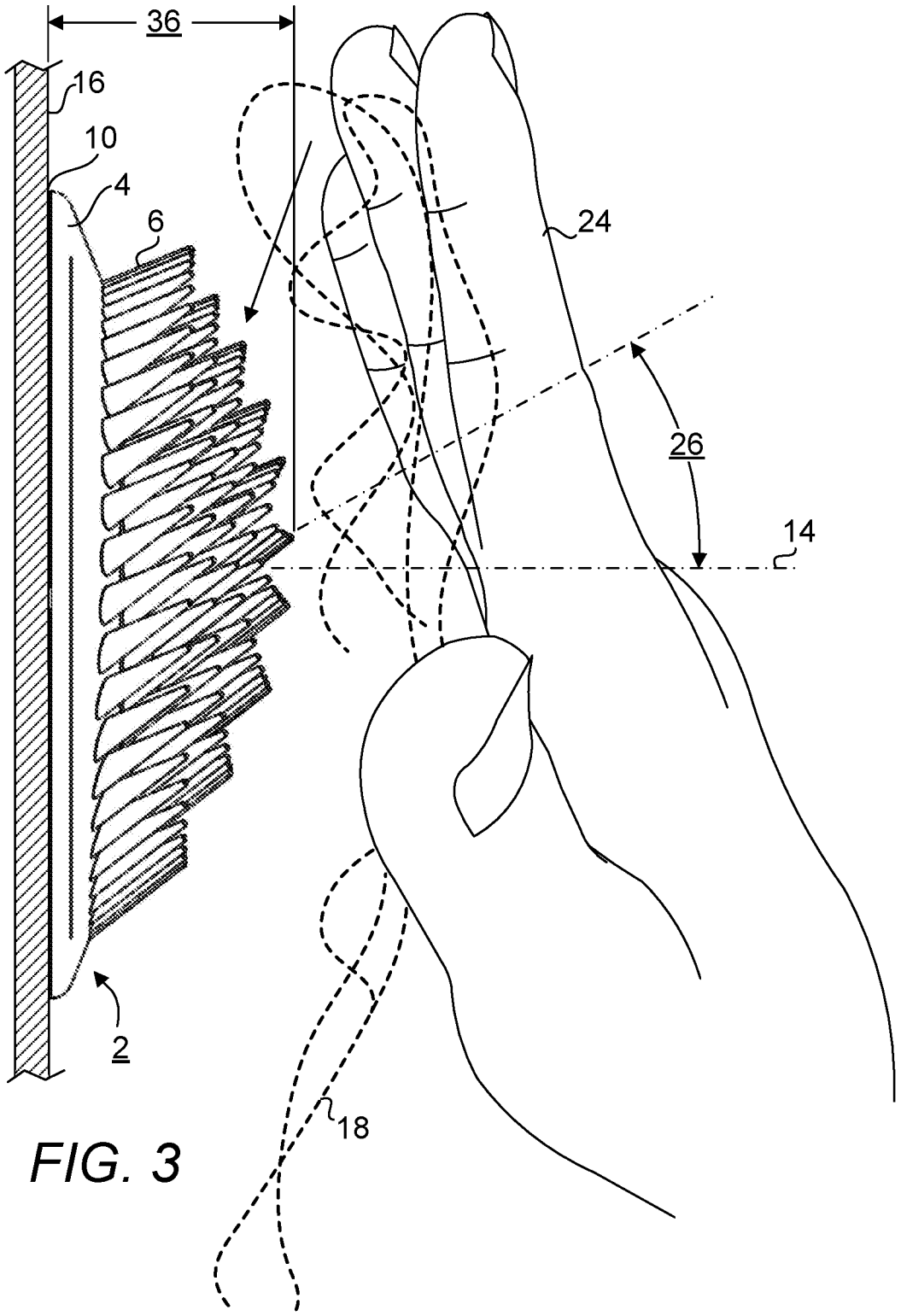
FIG. 3 is a left side view of one embodiment of a loose strand retainer where the loose strand retainer is shown attached to a support surface.

FIG. 2 is a front view of one embodiment of a loose strand retainer 2. Note that the loose strand retainer 2 is configured in a manner such that its length aligns horizontally with a support surface 16. In one embodiment, the length 20 of the base 4 ranges from about 4.5 inches to about 5.5 inches while the width 22 of the base 4 ranges from about 3 inches to about 4 inches. FIG. 3 is a left side view of one embodiment of a loose strand retainer 2 where the loose strand retainer 2 is shown attached to a support surface 16. The installed height 36 of the loose strand retainer 2 ranges from about 0.5 inch to about 1.5 inches. It shall be noted that, upon installation, the bottom surface of the loose strand retainer 2 is completely sealed, leaving no gap for splashes or overspray to reach the bottom surface. Here, the edge 10 of base 4 is sealed against the support surface 16. In one embodiment, the attachment means 8 includes a lip 30 (see FIG. 6) that is disposed about a periphery of the base 4, the lip 30 configured to seal the base 4 on the bottom surface from an ambient environment when the loose strand retainer 2 has been attached to the support surface 16 to avoid intrusion of any fluids at the bottom surface. In one embodiment, the lip 30 is a part of a suction cup used to secure the device to a support surface. In FIG. 3, it can be seen that the plurality of protrusions 6 are biased with respect to a central plane 14 of the loose strand retainer that can be thought of as a plane that extends into the figure. The bias angle 26 of the protrusions 6 preferably ranges from about 0 degree to about 60 degrees and more preferably from about 30 degrees to about 45 degrees. In use, loose hair collected from one's hair in one's hand 24, e.g., by rubbing the hand 24 against one's head or picking up from a sink or shower, is rubbed against the loose strand retainer 2 in the direction indicated. The loose hair 18 is lodged amongst the protrusions 6 before being removed, at the end of a shower or bath or at the time when the shower or bath is cleaned. The loose strand retainer 2 may be used multiple times before the collected hair becomes so abundant that more loose hair is prevented from being collected there.

Figure 4:
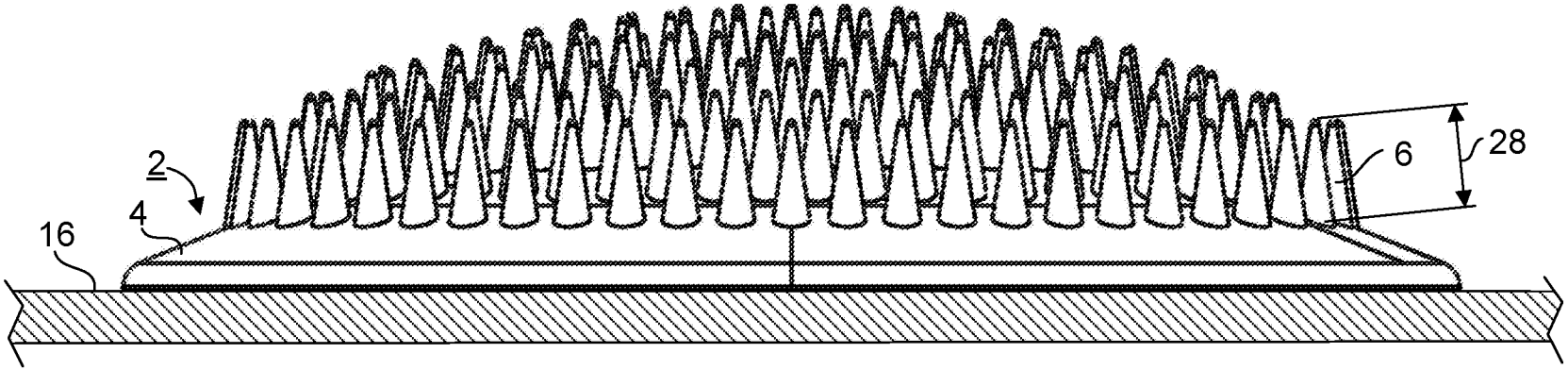
FIG. 4 is a top view of one embodiment of a loose strand retainer where the loose strand retainer is shown attached to a support surface.
Figure 5:
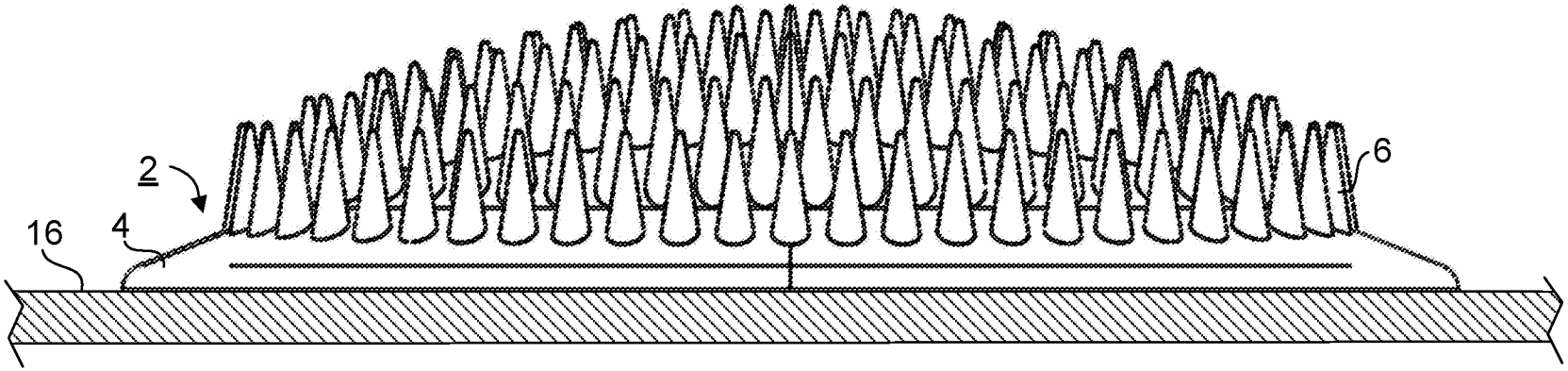
FIG. 5 is a bottom view of one embodiment of a loose strand retainer where the loose strand retainer is shown attached to a support surface.

FIG. 4 is a top view of one embodiment of a loose strand retainer 2 where the loose strand retainer 2 is shown attached to a support surface 16. FIG. 5 is a bottom view of one embodiment of a loose strand retainer 2 where the loose strand retainer 2 is shown attached to a support surface 16. In one embodiment, the height 28 of at least one of the plurality of protrusions preferably ranges from about 0.5 inch to about 1 inch.

Figure 6:
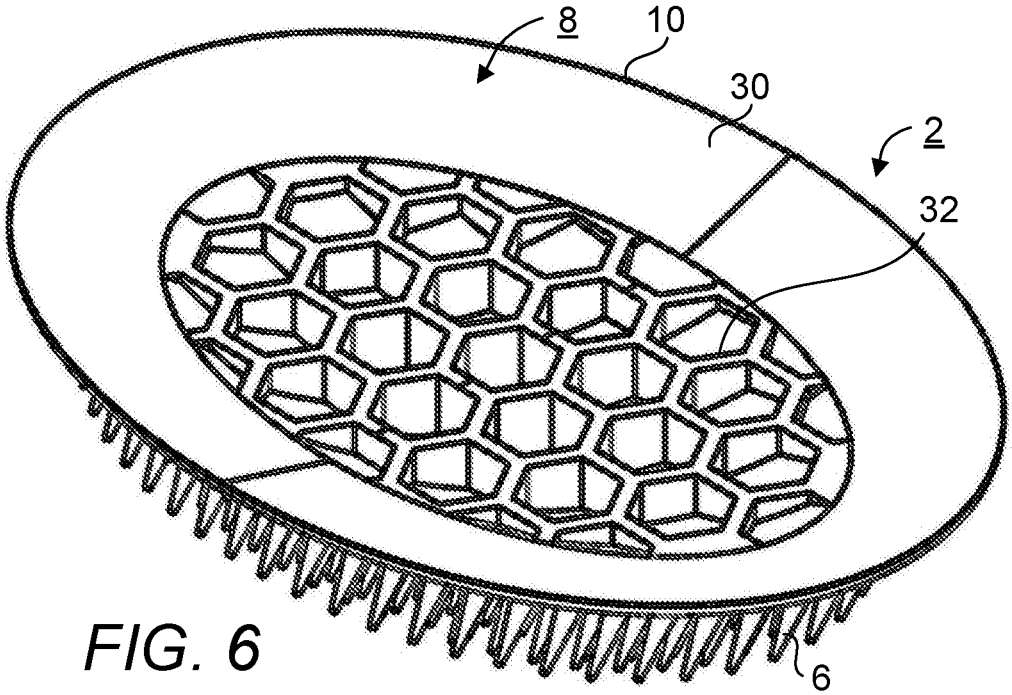
FIG. 6 is a rear perspective view of one embodiment of a loose strand retainer.
Figure 7:
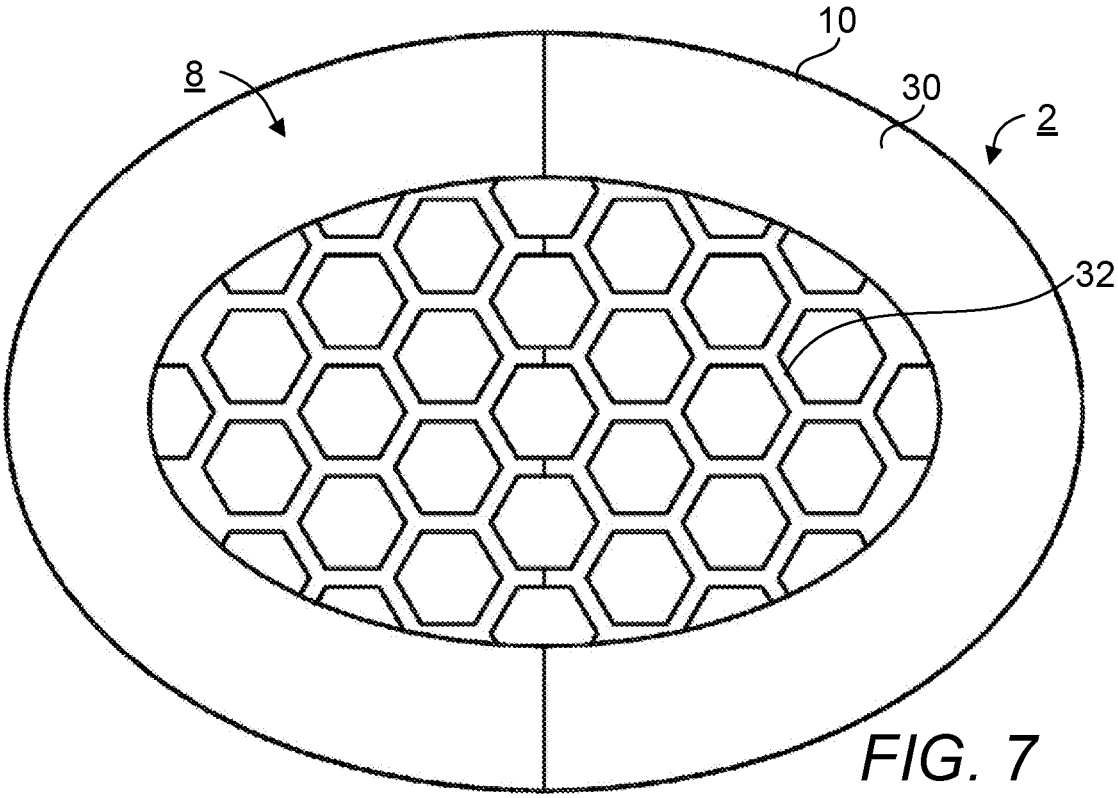
FIG. 7 is a rear view of one embodiment of a loose strand retainer.
Figure 8:
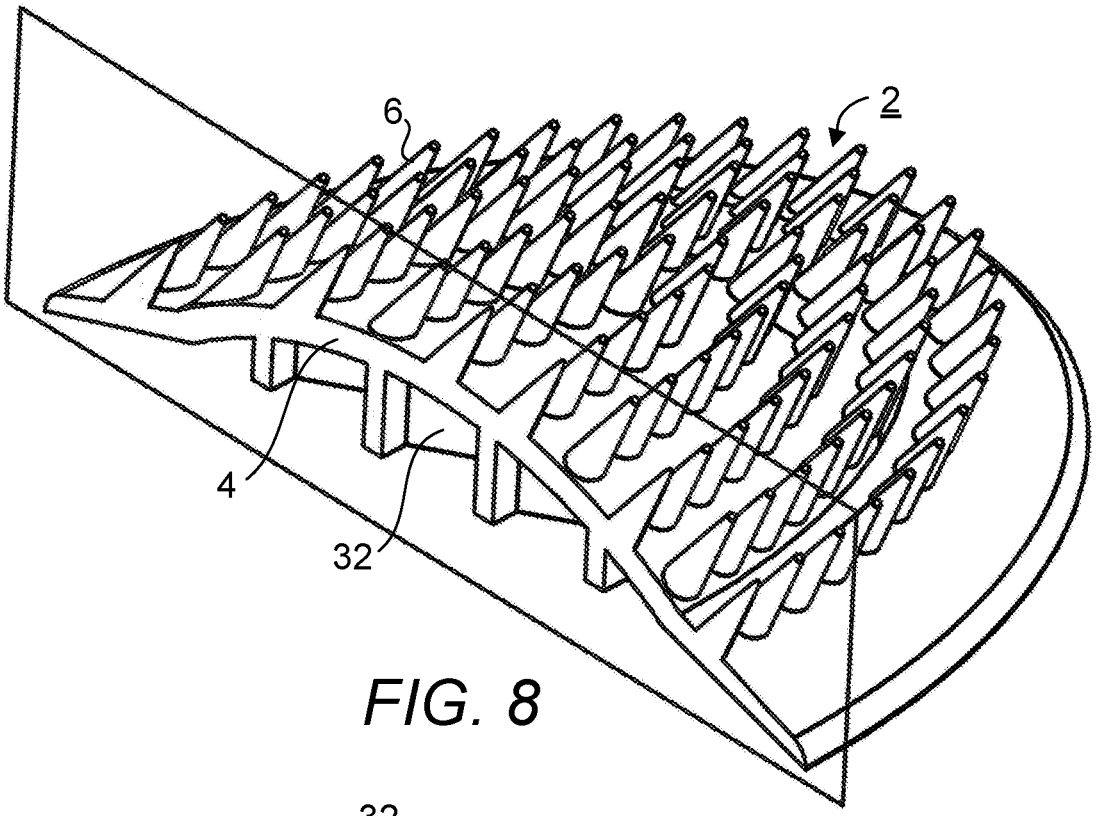
FIG. 8 is a front sectional view of one embodiment of a loose strand retainer.
Figure 9:
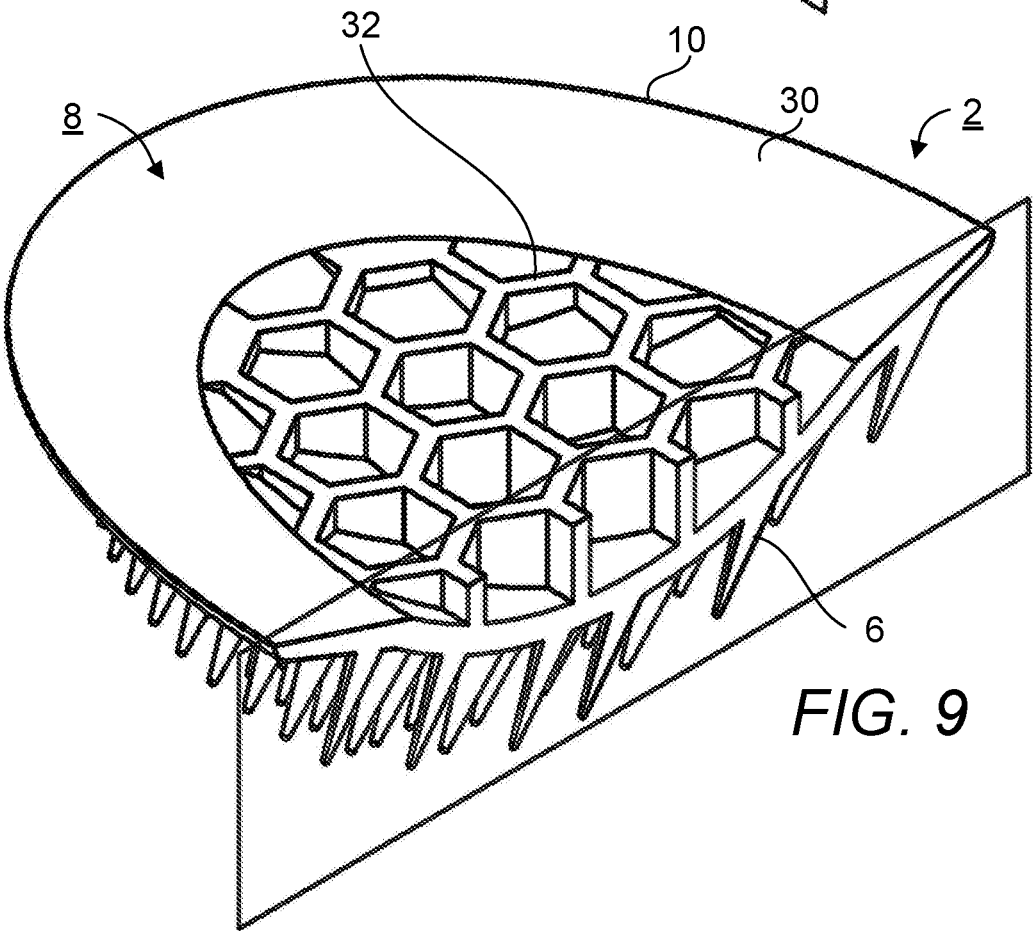
FIG. 9 is a rear sectional view of one embodiment of a loose strand retainer.
Figure 10:
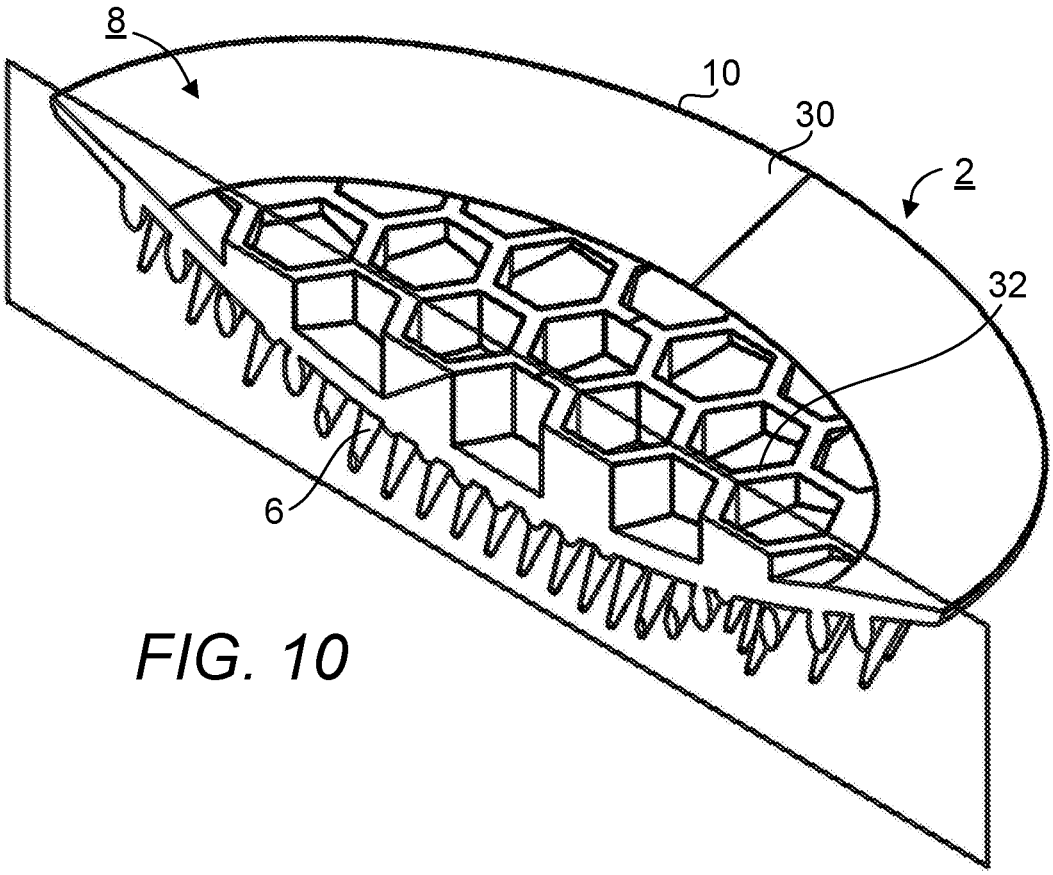
FIG. 10 is a rear sectional view of one embodiment of a loose strand retainer.

FIG. 6 is a rear perspective view of one embodiment of a loose strand retainer 2. FIG. 7 is a rear view of one embodiment of a loose strand retainer 2. FIG. 8 is a front sectional view of one embodiment of a loose strand retainer 2. FIG. 9 is a rear sectional view of one embodiment of a loose strand retainer 2. FIG. 10 is a rear sectional view of one embodiment of a loose strand retainer 2. Here, the attachment means is a suction cup that is disposed on the bottom surface of the loose strand retainer 2. The suction cup includes a lip 30 disposed about the periphery of the base 4. There is further provided a structure 32 useful for providing rigidity to the base 4. Here, one such structure that is suitable for this purpose is a honeycomb structure which not only gives the base a form but also lightweight at the same time. Other structures may be used as long as they do not significantly add to the weight of the loose strand retainer and that the structures do not negatively affect the proper functioning of the attachment means. Referring back to FIG. 8, it shall be noted that the top surface is preferably dome-shaped such that any substantial amount of moisture coming in contact with the top surface has the tendency to roll off the top surface such that it can remain dry and be free from mold.

FIG. 11 is a top front perspective view of another embodiment of a loose strand retainer 2. FIG. 12 is a right side view of the embodiment of a loose strand retainer 2 shown in FIG. 11. Here, extensions 12 are configured to extend from some of the protrusions or those on the top periphery of the base 4. Such extensions 12 provide additional surfaces that help to entangle loose hair 18 rubbed against the protrusions, making the transfer of the loose hair 18 to the loose strand retainer 2 even more effective.

Figure 13:
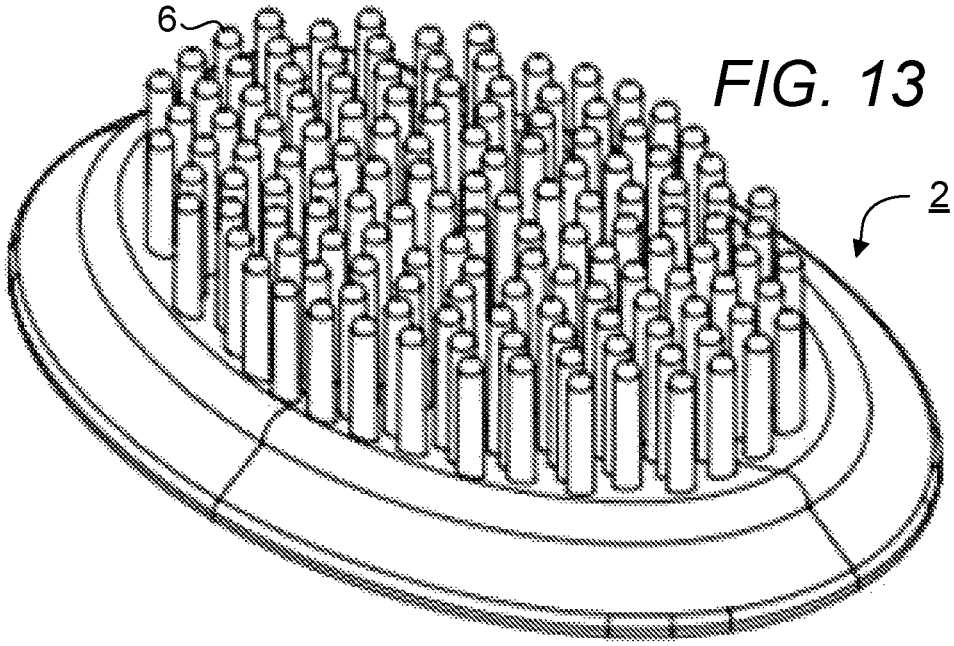
FIG. 13 is a top perspective view of yet another embodiment of a loose strand retainer.
Figure 14:
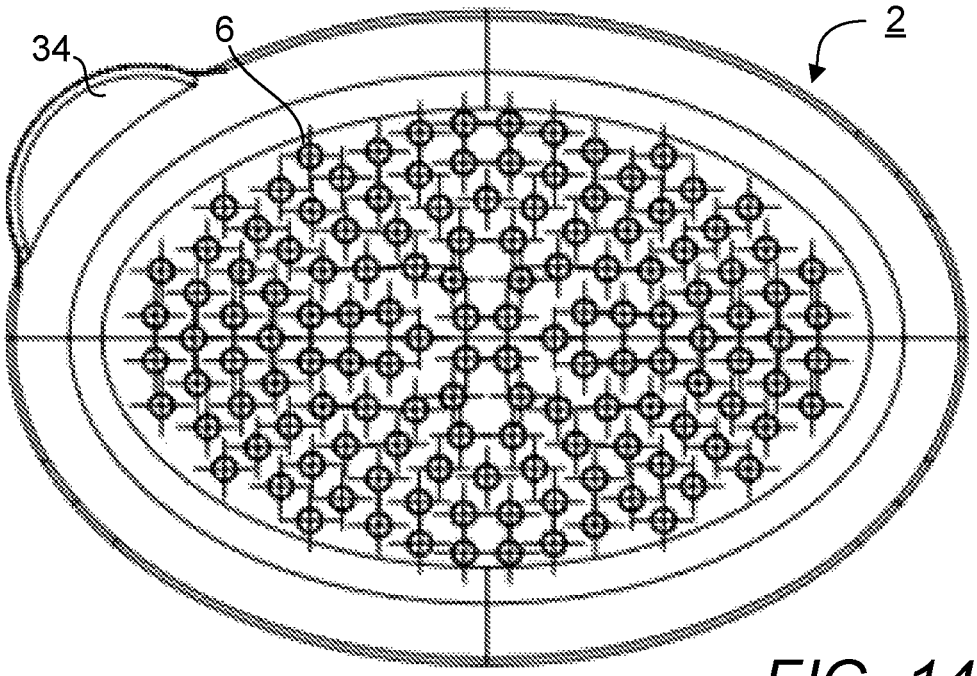
FIG. 14 is a top view of the embodiment of loose strand retainer of FIG. 13.

FIG. 13 is a top perspective view of yet another embodiment of a loose strand retainer 2. FIG. 14 is a top view of the embodiment of loose strand retainer 2 of FIG. 13. Here, the plurality of protrusions 6 do not terminate to pointed ends but rather the protrusions each have a constant diameter throughout lengthwise. A pull tab 34 is disposed at a portion of the periphery of the base 4. The pull tab 34 facilitates dislodgement of the loose strand retainer 2 from a support surface to which the loose strand retainer 2 is attached. Upon attachment to a support surface, the loose strand retainer 2 will remain attached until such time when the user grabs the loose strand retainer 2 by the pull tab 34, altering the structure of the suction cup to allow air to enter the suction cup between the lip 30 and the support surface to which the device is attached and disable any suction effect of the suction cup such that the loose strand retainer 2 can be detached from the support surface. A similar pull tab can be applied to any bases disclosed elsewhere herein.

In one embodiment, the loose strand retainer 2 is constructed as a single unit. In one embodiment, the loose strand retainer 2 is constructed from a mold-free, mildew-resistant, resilient material, e.g., silicone, thermoplastic elastomer (TPE) and thermoplastic polyurethane (TPU). The resilience of the protrusions allows a user's hand to interact more snugly with the protrusions, facilitating transfer of one or more strands of loose hair to the spaces amongst the protrusions. The same resilience also allows the user to grasp loose hair more readily while removing the loose hair collected in the loose strand retainer.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A loose strand retainer comprising:

(a) a plurality of protrusions;

(b) only one base, said only one base comprising a dome-shaped top surface from which said plurality of protrusions extend and a bottom surface, said plurality of protrusions configured for receiving and retaining loose strands; and (c) a lip extending outward from an outer periphery of said top surface forming a suction cup with said bottom surface, said suction cup configured to cooperate with a support surface to form a suction force for attaching said loose strand retainer to the support surface, said lip configured to seal said only one base against said support surface from an ambient environment when said loose strand retainer has been attached to said support surface and to avoid intrusion of fluids at said bottom surface.

2. The loose strand retainer of claim 1, wherein said base further comprises a central plane and said plurality of protrusions are angularly biased with respect to said central plane.

3. The loose strand retainer of claim 1, wherein said only one base comprises a plurality of tubes formed in said bottom surface, each tube comprising an opening configured to face said support surface.

4. The loose strand retainer of claim 3, wherein at least one of said plurality of tubes comprises a cross-sectional shape of a honeycomb.

5. The loose strand retainer of claim 1, wherein said plurality of protrusions are disposed on said top surface at a density of about 15 to about 20 per square inch.

6. The loose strand retainer of claim 1, further comprising a pull tab attached to said base.

7. The loose strand retainer of claim 1, wherein at least one of said plurality of protrusions extends from said top surface to a pointed end.

8. The loose strand retainer of claim 1 is constructed as a single unit.

9. The loose strand retainer of claim 1, is constructed from a resilient material selected from the group consisting of silicone, thermoplastic elastomer (TPE) and thermoplastic polyurethane (TPU).

10. The loose strand retainer of claim 1, wherein the height of at least one of said plurality of protrusions ranges from about 0.5 inch to about 1 inch.

* * * * *